US005163678A

United States Patent [19]

Rogers

[11] Patent Number: 5,163,678

[45] Date of Patent: Nov. 17, 1992

[54] BOWLER'S WRIST POSITIONER

[75] Inventor: Carl L. Rogers, Hopkinsville, Ky.

[73] Assignee: Ebonite International, Inc., Hopkinsville, Ky.

[21] Appl. No.: 763,154

[22] Filed: Sep. 20, 1991

[51] Int. Cl.[5] ..... A63B 69/00

[52] U.S. Cl. ..... 273/54 B; 273/DIG. 30; 2/16; 2/161 A

[58] Field of Search ..... 273/54 B, 189 R, 189 A, 273/DIG. 30; 128/77, 87 R, 87 A, 89 R, DIG. 15; 2/16, 162, 163, 161 A, DIG. 6

[56] References Cited

U.S. PATENT DOCUMENTS

| | | | |
|---|---|---|---|
| 1,964,694 | 6/1934 | Longfellow | 128/89 R |
| 2,767,708 | 10/1956 | Keropian | 128/87 A X |
| 3,606,342 | 9/1971 | Albertson | 273/54 B |
| 3,865,383 | 2/1975 | Clay et al. | 273/183 B |
| 4,176,840 | 12/1979 | Lanning | 273/54 B |
| 4,245,841 | 1/1981 | Owens | 273/183 B |
| 4,371,163 | 2/1983 | Shaffer et al. | 273/54 |
| 4,666,158 | 5/1987 | Moro | 273/54 B |
| 4,677,971 | 7/1987 | Lindemann | 273/54 B X |
| 4,846,473 | 6/1989 | Fleenor et al. | 273/54 B |
| 5,025,801 | 6/1991 | Callaway | 128/89 R X |

FOREIGN PATENT DOCUMENTS

| | | | |
|---|---|---|---|
| 2166959 | 5/1986 | United Kingdom | 273/189 A |

OTHER PUBLICATIONS

Advertisement of Cobra Products of America from "Bowling Digest", Nov./Dec. 1989.

*Primary Examiner*—Paul E. Shapiro
*Assistant Examiner*—Sebastiano Passaniti
*Attorney, Agent, or Firm*—Kinzer, Plyer, Dorn, McEachran & Jambor

[57] ABSTRACT

A wrist positioner for a bowler comprised of hand, forearm and finger backup members. Fastening means secure the positioner to the back of the bowler's forearm and hand. The hand and backup members are rotatably connected by two aligned pivotal connections located at opposited sides of the wrist of the bowler. The position of a pin extending through the intersection of slots in the hand and backup members may be adjusted to set the angular orientation of the backup members, relative to each other within a predetermined range.

9 Claims, 2 Drawing Sheets

BOWLER'S WRIST POSITIONER

BACKGROUND OF THE INVENTION

In order to achieve success in the game of bowling, it is necessary to release the ball in a manner such that it is engaged in two types of motion.

The first motion, "roll", is a rotation of the ball about its horizontal axis, which propels it down the alley toward the pins. The second motion, "spin", is a rotation of the ball about its vertical axis. The manner in which the pins scatter after being struck is dictated largely by the "roll" and "spin" combination imparted to the ball.

Some bowlers experience great difficulty in achieving an effective combination of these two motions. Too much spin may cause the ball to strike the pins too far off center or may even cause the ball to veer off the alley before it reaches the pins. Too little spin may be ineffective in achieving the desired scattering of the pins. Too much or too little roll may, respectively, overwhelm or be overwhelmed by the spin motion.

Experimentation by those skilled in the game has shown that reinforcing the wrist, hand and fingers of the bowler and limiting their relative movement during release aids in attaining an ideal combination of spin and roll. Of particular importance is maintaining the wrist and forefinger at a steady angle throughout delivery and release of the ball.

A number of prior art devices have been unsuccessful in achieving a consistent, effective combination of the roll and spin motions. Only of the best, the device of U.S. Pat. No. 4,371,163, successfully limits the movement of both the wrist and the forefinger. But a significant drawback of that device is that the angle at which the wrist is held may not be adjusted. The most comfortable wrist angle varies from bowler to bowler. Furthermore, different combinations of spin and roll may be achieved by varying the angle at which the wrist is held. Through experimentation, a bowler can determine his ideal wrist angle in terms of both comfort and effectiveness. Limitation of the wrist to one particular angle may impose a corresponding limitation on the bowler's game, as the bowler may be much more effective with his wrist held at another angle.

SUMMARY OF THE INVENTION

Accordingly, it is a primary object of this invention to provide a wrist positioner for a bowler which holds the wrist at a constant angle during delivery and release of the ball and which can be adjusted to the precise angle desired by a particular bowler.

Another object of this invention is to hold the bowler's forefinger steady and at a constant angle during delivery and release of the ball.

These and other objects of this invention will become apparent in the ensuing drawings, specifications and claims.

Accordingly, the invention relates to a wrist positioner for use by a bowler adapted to be mounted in a predetermined position of use on the back of the hand and the forearm of a bowler. The wrist positioner comprises a hand backup member that, when the positioner is mounted in its position of use, extends from the bowler's wrist across a part of the back of the bowler's hand, a forearm backup member that, when the positioner is mounted in its position of use, extends from the wrist of the bowler along a part of the back of the bowler's forearm, and latching hinge means, that, when the positioner is mounted in its position of use, is located at the back of the bowler's wrist, interconnecting the hand and forearm backup members and establishing and maintaining the backup members at any preselected angle relative to each other within a predetermined range of angles. The latching hinge means comprises pivotal connection means connecting the hand backup member and the forearm backup member at the wrist of the bowler when the positioner is mounted in its position of use, a first slot, in the hand backup member, and a second slot, in the forearm backup member; the first and second slots each extend transversely across the back of the bowler's wrist when the positioner is mounted in its position of use, and the first and second slots are aligned relative to each other so that the two slots intersect. The intersection of the first and second slots varys along the lengths of the slots in accordance with changes in the angular orientation of the backup members relative to each other. A pin extends through the intersection of the first and second slots, and releasable fastener means, mounted on the pin, firmly hold the backup members at any angle, relative to each other, within the predetermined range. Fastening means secure the wrist positioner to the hand and forearm of the bowler in its position of use.

DETAILED DESCRIPTION OF A PREFERRED EMBODIMENT

Figure 1:
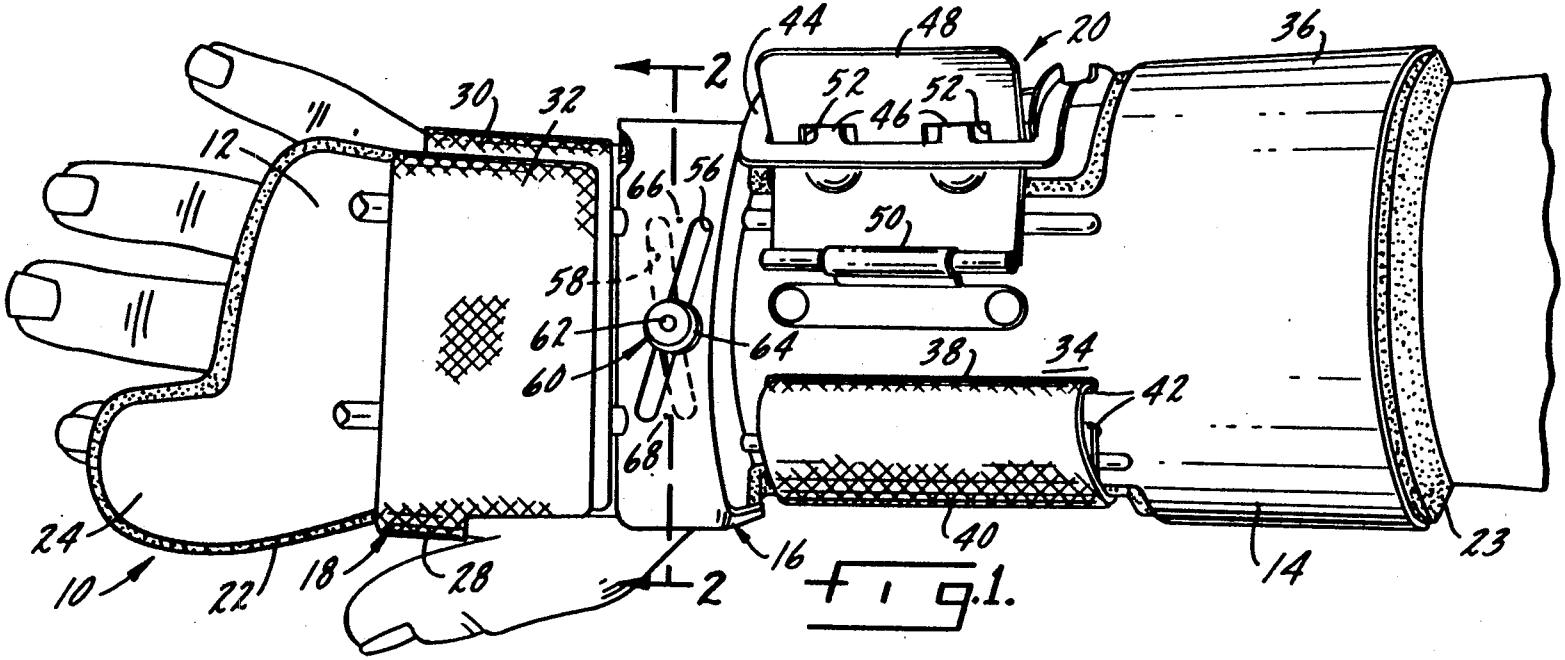
FIG. 1 is a plan view of one embodiment of the wrist positioner of the invention as it appears when properly worn by a bowler.

A properly worn wrist positioner 10, according to one embodiment of the invention, is illustrated in FIG. 1. Wrist positioner 10 is comprised of a hand backup member 12 and a forearm backup member 14 rotatably connected by latching hinge means 16. Hand fastening means 18 and forearm fastening means 20 are located upon, respectively, hand backup member 12 and forearm backup member 14.

Hand backup member 12 and forearm backup member 14 are formed of a rigid material, typically sheet metal. A first layer of resilient cushioning material, shown in FIGS. 3 and 4 at 22, is attached to the hand backup member 12; a second layer of resilient cushioning material 23 is secured to the forearm backup member 14. Typically, the cushioning material for layers 22 and 23 is an elastomer.

Figure 3:
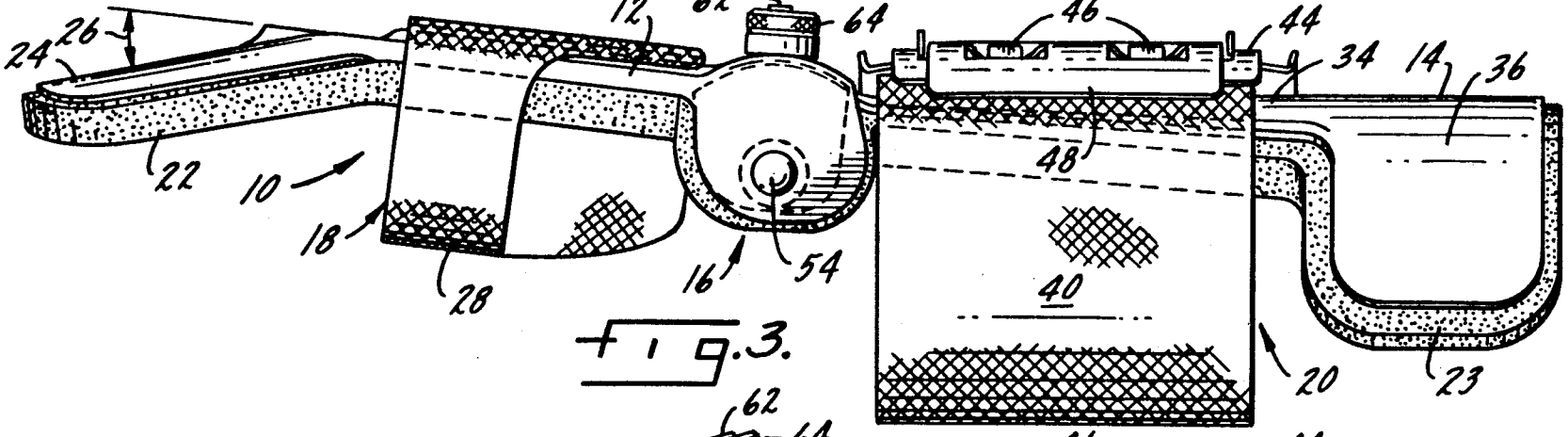
FIG. 3 is a side elevation view of the wrist positioner set at its maximum upward angle.
Figure 4:
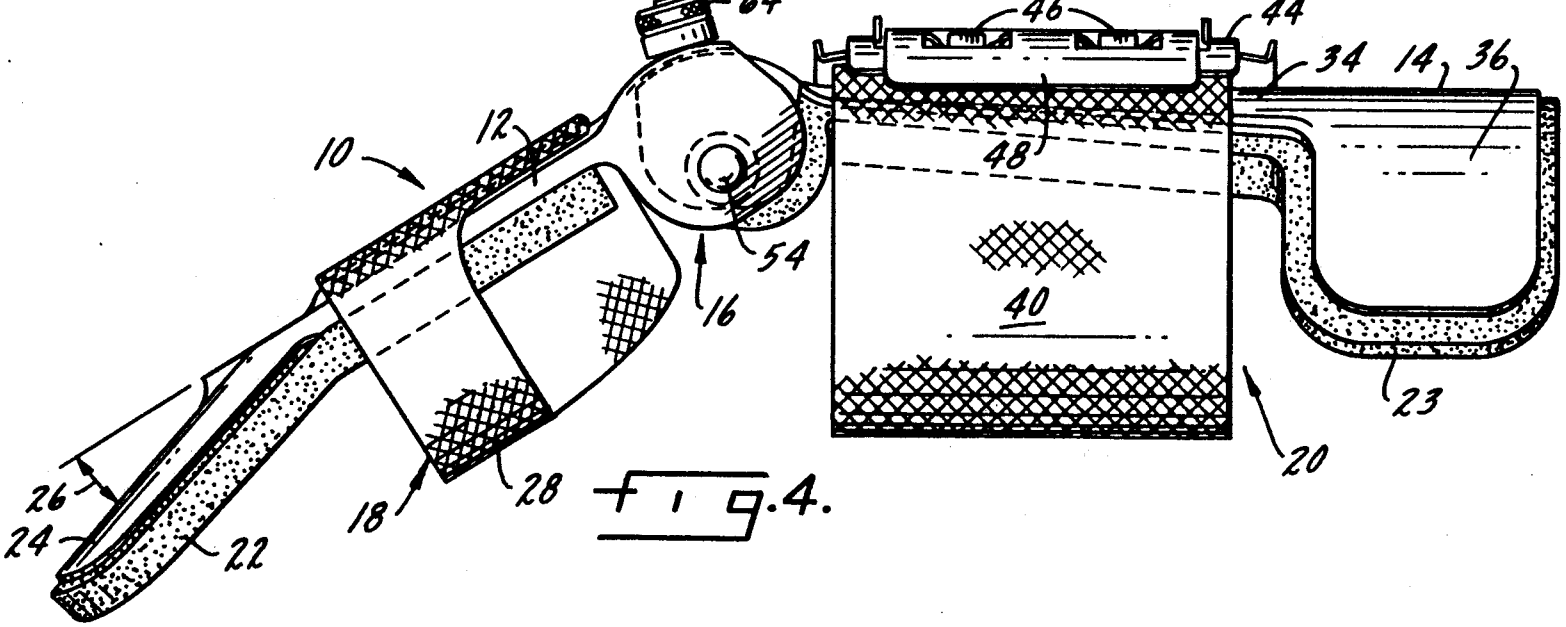
FIG. 4 is a side elevation view of the wrist positioner set at its maximum downward angle.

Hand backup member 12 extends from the bowler's wrist across a portion of the back of the bowler's hand. Member 12 is substantially flat and should have a width no greater than the width of the bowler's hand. A substantially flat finger backup element 24 projects from hand backup member 12 across a part of the bowler's forefinger; preferably, element 24 has a width greater than that of the bowler's forefinger. FIGS. 3 and 4 show that finger backup element 24 projects forwardly and downwardly at a small acute angle 26 with respect to hand back up member 12. Typically, angle 26 is approximately 6 degrees. Finger backup element 24 serves to stabilize the bowler's forefinger during release of the ball.

Hand fastening means 18 consists of a narrow elongated strip 28 of flexible, pliant material connecting two ends 30 and 32. End 30 is permanently affixed to the surface of hand backup member 12. The top side of end 30 and the bottom side of end 32 are equipped with multi-hook type (e.g., VELCRO brand) materials which adhere when pressed together. Hand backup member 12 is firmly secured to the back of the bowler's hand by wrapping elongated strip 28 across the bowler's palm and then fastening its free end 32 to the fixed end 30 by pressing the ends of the strip together.

Forearm backup member 14 includes a substantially flat portion 34 which extends from latching hinge means 16 along the back of the lower forearm of the bowler, and has a width approximately equal to that of the bowler's forearm. At the end of flat portion 34 is a curved portion 36. As seen more clearly in FIGS. 3 and 4, curved portion 36 wraps around and partially encloses the lower forearm of the bowler.

Forearm fastening means 20 is located on flat portion 34 of forearm backup member 14. One end 38 of an elongated strip 40 of flexible, pliant material is threaded through two slots 42 in the flat portion 34 of forearm backup member 14. The other end of strip 40 is permanently affixed to a first buckle member 44. First buckle member 44 has a hollow, rectangular frame with two inwardly projecting tabs 46 located on one edge of the frame. A second buckle member 48 is rotatably attached by a hinge 50 to the flat portion 34 of forearm backup member 14. The second buckle member 48 consists of a square frame formed with two receptacle slots 52 positioned to receive the tabs 46 of first buckle member 44.

Forearm fastening means 20 operates as follows. A sufficient length of end 38 of strip 40 is passed through slots 42 such that when strip 40 is wrapped around the bowler's forearm, forearm backup member 14 is snugly secured to the bowler's forearm. After strip 40 has been wrapped around the bowler's forearm, tabs 46 of the first buckle member 44 are inserted into slots 52 of the second buckle member 48. Second buckle member 48 is then rotated on its hinge 50 to its closed position (FIGS. 3,4), thus securing the forearm backup member to the bowler's forearm.

Figure 2:
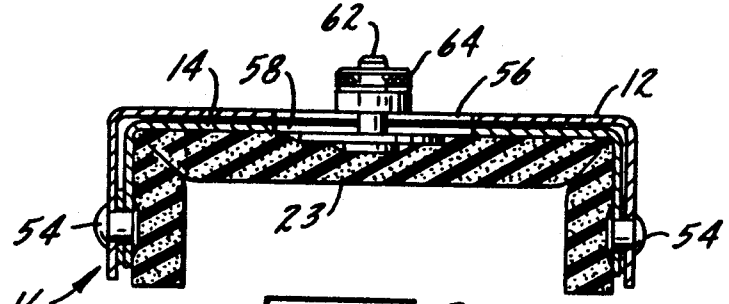
FIG. 2 is a cross-section of the wrist positioner, taken approximately along line 2—2 in FIG. 1.

A cross section of latching hinge means 16 is shown in FIG. 2. Two aligned pivotal connections 54, located at opposite sides of the wrist of the bowler, rotatably join overlapping portions of hand backup member 12 and forearm backup member 14. A first slot, indicated in FIGS. 1 and 2 at 56, is located in hand backup member 12 and extends transversely of, but at a slight angle to the bowler s wrist. A second, similar slot 58 in forearm backup member 14 extends transversely of, but at a slight angle to the bowler's wrist.

Slots 56 and 58 are aligned to intersect each other as indicated at point 60 in FIG. 1. A threaded pin, illustrated in FIG. 2 at 62, extends through the intersection of the two slots. A nut 64, which may have a knurled exterior, holds the pin in place. The angular orientation of the hand and forearm backup members 12 and 14 is varied by adjusting the location of pin 62. When nut 64 is loosened, hand and forearm backup members 12 and 14 may be rotated upon pivotal connections 54 by moving pin 62 through the range of intersections of slots 56 and 58.

When pin 62 is moved to one extreme of the range of intersections, indicated in FIG. 1 at 66, hand backup member 12 is aligned at an angle of approximately thirty degrees downwardly of forearm backup member 14. A side view of wrist positioner set at this extreme is shown in FIG. 4. When pin 62 is moved to the other extreme, indicated in FIG. 1 at 68, hand backup member 12 is positioned at an angle of approximately six degrees upwardly of forearm backup member 14. A side view of a wrist positioner set at this extreme is shown in FIG. 3. The bowler may set the angle of the wrist positioner at a desired angle within this range of about 36° by moving pin 62 to an appropriate position between the extremes 66 and 68. Once the desired angle is achieved, nut 64 is tightened to hold backup members 12 and 14 firmly in place in the desired angular relationship.

Whereas one form of the invention has been shown and described herein, it should be realized that many modifications, substitutions and alterations may be made in the wrist positioner without departing from the essential scope of the invention.

I claim:

1. A wrist positioner for use by a bowler, adapted to be mounted in a predetermined position of use on the back of the hand and the forearm of a bowler, comprising:

a hand backup member that, when the positioner is mounted in its position of use, extends from the bowler's wrist across a part of the back of the bowler's hand;

a forearm backup member that, when the positioner is mounted in its position of use, extends from the wrist of the bowler along a part of the back of the bowler's forearm;

latching hinge means, that, when the positioner is mounted in its position of use, is located at the back of the bowler's wrist, interconnecting the hand and forearm backup members and establishing and maintaining the backup members at any preselected angle relative to each other within a predetermined range of angles;

the latching hinge means comprising:

pivotal connection means connecting the hand backup member and the forearm backup member at the wrist of the bowler when the positioner is mounted in its position of use;

a first slot, in the hand backup member;

a second slot, in the forearm backup member;

the first and second slots being each extending across the back of the bowler's wrist when the positioner is mounted in its position of use, and the first and second slots being aligned relative to each other so that the two slots intersect;

the intersection of the first and second slots varying along the lengths of the slots in accordance with changes in the angular orientation of the backup members relative to each other;

a pin extending through the intersection of the first and second slots; and releasable fastener means, mounted on the pin, for firmly holding the backup members at any angle, relative to each other, within the predetermined range;

and fastening means for securing the wrist positioner to the hand and forearm of the bowler in its position of use.

2. A wrist positioner according to claim 1 and further comprising a finger backup element projecting from the hand backup member across a part of the back of the bowler's forefinger, the finger backup element having a width greater than that of the bowler's forefinger.

3. A wrist positioner according to claim 2 wherein the finger backup element projects forwardly and downwardly at a small acute angle with respect to the hand backup member.

4. A wrist positioner according to claim 3 wherein the finger backup element is an integral part of the hand backup member and the angle between the finger backup element and the hand backup member is approximately six degrees.

5. A wrist positioner according to claim 3 wherein the hand backup member and the finger backup element are each substantially flat.

6. A wrist positioner according to claim 1 wherein the predetermined range of angles for the latching hinge means is approximately thirty degrees downwardly and approximately six degrees upwardly for the hand backup member relative to the forearm backup member.

7. A wrist positioner according to claim 1 wherein the first and second slots are linear slots intersecting at an acute angle.

8. A wrist positioner according to claim 1 wherein the pin is threaded and the fastener means comprises a nut threaded onto the pin.

9. A wrist positioner according to claim 1 and further comprising a finger backup element projecting from the hand backup member across a part of the back of the bowler's forefinger, the finger backup element having a width greater than that of the bowler's forefinger.

* * * * *